US008500204B2

(12) United States Patent
Kemp

(10) Patent No.: US 8,500,204 B2
(45) Date of Patent: Aug. 6, 2013

(54) KNOCK-DOWN FURNITURE ASSEMBLY

(75) Inventor: James Foster Kemp, Pelham, AL (US)

(73) Assignee: Casual Living Worldwide, Inc., Louisville, KY (US)

( * ) Notice: Subject to any disclaimer, the term of this patent is extended or adjusted under 35 U.S.C. 154(b) by 302 days.

(21) Appl. No.: 12/862,199

(22) Filed: Aug. 24, 2010

(65) Prior Publication Data

US 2012/0049591 A1 Mar. 1, 2012

(51) Int. Cl.
*A47C 3/025* (2006.01)

(52) U.S. Cl.
USPC ..... 297/440.14; 297/440.22; 297/265.1; 297/302.4

(58) Field of Classification Search
USPC ..... 297/440.1, 440.14, 440.15, 264.1, 297/265.1, 302.4, 440.22
See application file for complete search history.

(56) References Cited

U.S. PATENT DOCUMENTS

| | | | | |
|---|---|---|---|---|
| 135,465 | A * | 2/1873 | Chichester | 297/293 |
| 3,333,811 | A | 8/1967 | Matthews | |
| 3,917,312 | A * | 11/1975 | Rodaway | 280/250.1 |
| 4,365,840 | A | 12/1982 | Kehl et al. | |
| 4,596,423 | A * | 6/1986 | Towns et al. | 297/440.22 |
| 4,718,723 | A | 1/1988 | Bottemiller | |
| 4,786,106 | A | 11/1988 | Bottemiller | |
| 5,599,064 | A * | 2/1997 | Vanderminden, Sr. | 297/344.21 |
| 5,947,562 | A | 9/1999 | Christofferson et al. | |
| 6,913,317 | B2 * | 7/2005 | Vanderminden et al. | 297/344.24 |
| 6,918,632 | B2 | 7/2005 | Maki et al. | |
| 7,841,660 | B2 * | 11/2010 | Wang et al. | 297/260.1 |
| 2009/0218862 | A1 | 9/2009 | Du et al. | |

* cited by examiner

*Primary Examiner* — Sarah B McPartlin
(74) *Attorney, Agent, or Firm* — Lerner, David, Littenberg, Krumholz & Mentlik, LLP

(57) ABSTRACT

A ready to assemble article of furniture includes a connecting assembly to enable shipment of the article in a partially assembled condition. By the use of the connecting assembly, the user can quickly assemble the article of furniture. The connecting assembly includes brackets which are attached to the disassembled components of the article of furniture. The brackets are mateable with each other during the assembly process to secure the components together.

25 Claims, 12 Drawing Sheets

KNOCK-DOWN FURNITURE ASSEMBLY

BACKGROUND OF THE INVENTION

The present invention relates in general to the field of furniture and furniture assemblies. More specifically, the present invention relates to knock-down furniture which may be partially disassembled for compact and efficient packaging.

Historically, furniture was manufactured and packaged wholly assembled, where it was then shipped to various retailers or end users in a fully assembled condition. Particularly for end users, this method of delivery was preferred as no assembly was required. However, this method of manufacture has drawbacks in the current marketplace, as shipping of wholly assembled furniture leaves voids in the packaging, which add to the overall shipping cost per unit shipped. Although this method of delivery does remain a viable method, typically it is only utilized for high-end or specialty furniture.

A subset of this method is furniture that may be packaged in a predominantly assembled condition, but which may require connection of limited numbers of components. Furniture produced by these methods of manufacture are often referred to as knock-down or "K.D." furniture.

K.D. furniture suffer from a number of disadvantages over fully assembled furniture. In the case of furniture such as chairs having a base assembly such as a rocker mechanism, it has been the practice to manufacture and sell such furniture with a permanently attached base assembly. The permanently attached base assembly limits the ability to compactly package the furniture, and is undesirable because of the costs associated with shipping such furniture with the resultant large packaging voids. In addition, the joints formed between the consumer assembled components are often not as strong as joints which are factory assembled. As a result, the furniture may not last as long or be as stable in use. Even if the consumer assembled components are as stable as those which may be factory assembled, many end-users have the perception that such joints are less secure.

The present invention has arisen to solve the need for articles of furniture which are capable of being shipped in a relatively compact manner, but which do not require complete assembly by the end user. The present invention solves this need while also alleviating the concerns, justified or not, that end user assembled components suffer from strength or longevity deficiencies.

SUMMARY OF THE INVENTION

The present invention overcomes the shortcomings of the prior art by providing, in various embodiments, a partially assembled article of furniture, such as a rocking chair or rocking couch, that may be compactly and efficiently packaged for transportation while enabling the connection of joints that are secure and stable over the life of the article.

A ready to assemble article of furniture is described in accordance with one embodiment of the present invention. The article includes a base component for supporting the assembled article on a surface. A first support frame is coupled to the base component by a pair of spaced apart springs securing the first support frame in spaced apart relationship to the base component; First and second brackets are attached to the first support frame in spaced relationship. An occupant supporting component supports an occupant when secured to the base component. A second support frame is arranged underlying the occupant supporting component and coupled thereto. Third and fourth brackets are attached to the second support frame in spaced apart relationship, the first bracket connectable with the third bracket and the second bracket connectable with the fourth bracket when the supporting component is assembled to the base component.

The first bracket includes a projection and the third bracket includes an opening for receiving the projection when the supporting component is assembled to the base component. The second bracket includes an opening and the fourth bracket includes an opening aligned with the second bracket opening when the supporting component is assembled to the base component.

An article of furniture is described in accordance with another embodiment of the present invention. The article includes a base component for supporting the article of furniture on a surface. A first support is attached to the base component. A pair of spaced apart coiled springs attaches the first support frame and the base component in spaced apart relationship. First, second, third and fourth brackets are attached to the first support frame in opposing pairs; the first and second brackets each including a projection and the third and fourth brackets each including an opening. An occupant supporting component is provided for supporting an occupant. A second support frame is attached to the occupant supporting component. Fifth, sixth, seventh and eighth brackets are attached to the second support frame in opposing pairs, the fifth, sixth, seventh and eighth brackets each including an opening. The occupant supporting component secured to the base component by (i) the projections of the first and second brackets received with the opening of the fifth and sixth brackets, (ii) the openings of the third and seventh brackets being aligned and the openings of the fourth and eighth brackets being aligned, and (iii) a fastener received with the aligned openings of the fifth and sixth brackets and the seventh and eighth brackets.

A ready to assemble article of furniture includes a base component for supporting the assembled article on a surface. An occupant supporting component is provided for supporting an occupant when secured to the base component. A plurality of first brackets is coupled to the base component or the occupant supporting component and a plurality of second brackets is coupled to the occupant supporting component or the base component. One of the first brackets includes a projection for engagement with an opening in one of the second brackets, and another one of the first brackets includes an opening for alignment with another one of the second brackets for securing the base component to the occupant supporting component.

BRIEF DESCRIPTION OF THE DRAWINGS

The subject matter regarded as the invention is particularly pointed out and distinctly claimed in the concluding portion of the specification. The invention, however, both as to organization and methods of operation, together with features objects, and advantages thereof, may be best understood by reference to the following detailed description when read with the accompanying drawings in which:

DETAILED DESCRIPTION

Figure 1:
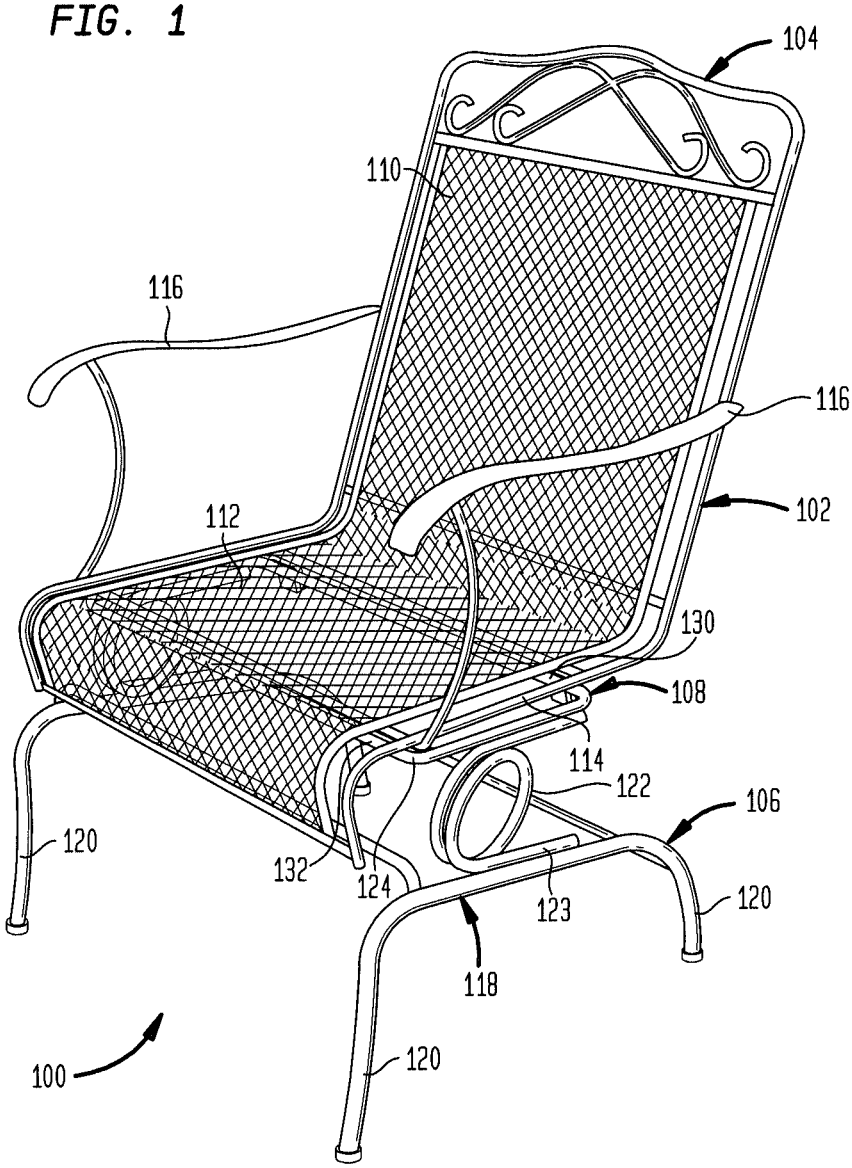
FIG. 1. is a perspective view of a an article of furniture of the knock-down type having a connection assembly constructed pursuant to one embodiment of the present invention.

In the following paragraphs are described the preferred embodiments of the furniture assembly in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Referring now to the drawings, wherein like reference numerals represent like elements, there is shown in FIG. 1 an article of furniture of the knock-down type which is packaged in a predominantly assembled condition in accordance with one embodiment of the present invention. The article of furniture has been designated generally by reference numeral 100, being illustrated as a chair 102. By way of example only, the chair 102 is of the rocker type, however, the present invention is applicable to any article of furniture having a base component which desirably is removable prior to shipping for reducing costs associated therewith. Moreover, although the article of furniture will be described in the context of the chair 102, it is to be understood that other articles of furniture, for example, loveseats, sofas, tables, or other articles of furniture which have a base component may incorporate the connection assembly in accordance with the present invention.

In the illustrated example, the chair 102 generally includes an occupant supporting component 104, a base component 106 and a connecting assembly 108. The occupant supporting component 104 is in the nature of a bucket type seat having a back rest portion 110, and an intregally formed seat portion 112. A connecting assembly support frame 114 is attached underlying the seat portion of the occupant supporting component 104. Optionally, the chair 102 may include side arms 116.

Figure 2:
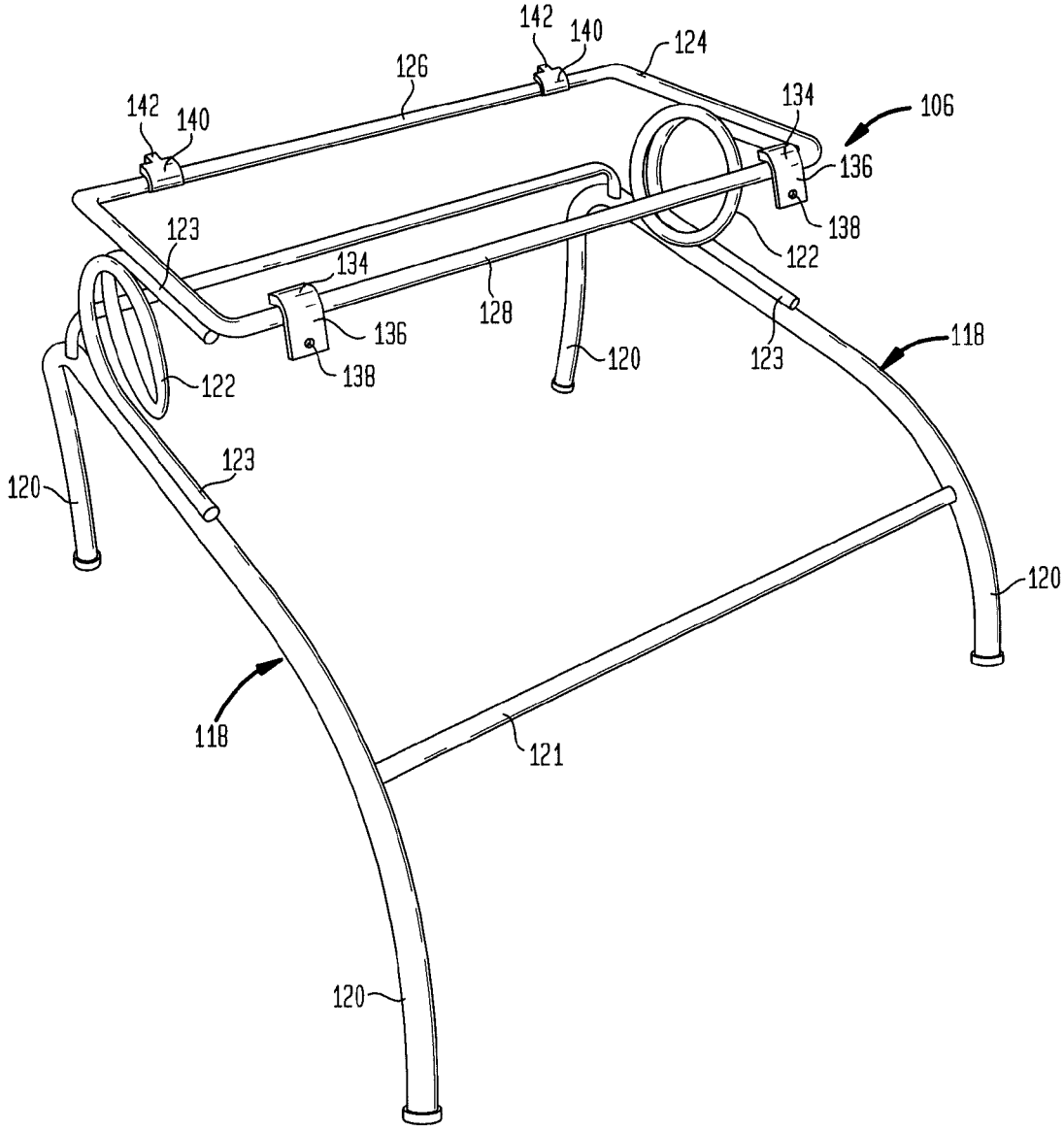
FIG. 2 is a perspective view of a base component of the article of furniture showing a portion of the connection assembly.
Figure 3:
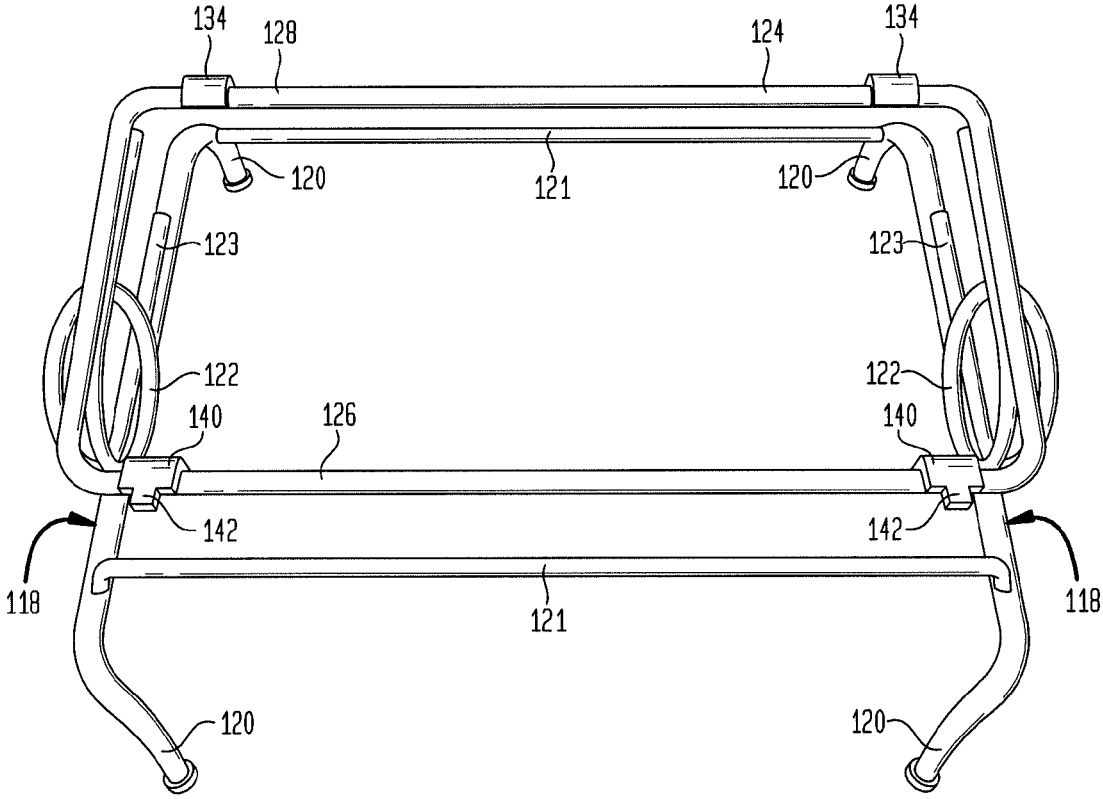
FIG. 3 is another perspective view of the base component showing a portion of the connection assembly.
Figure 4:
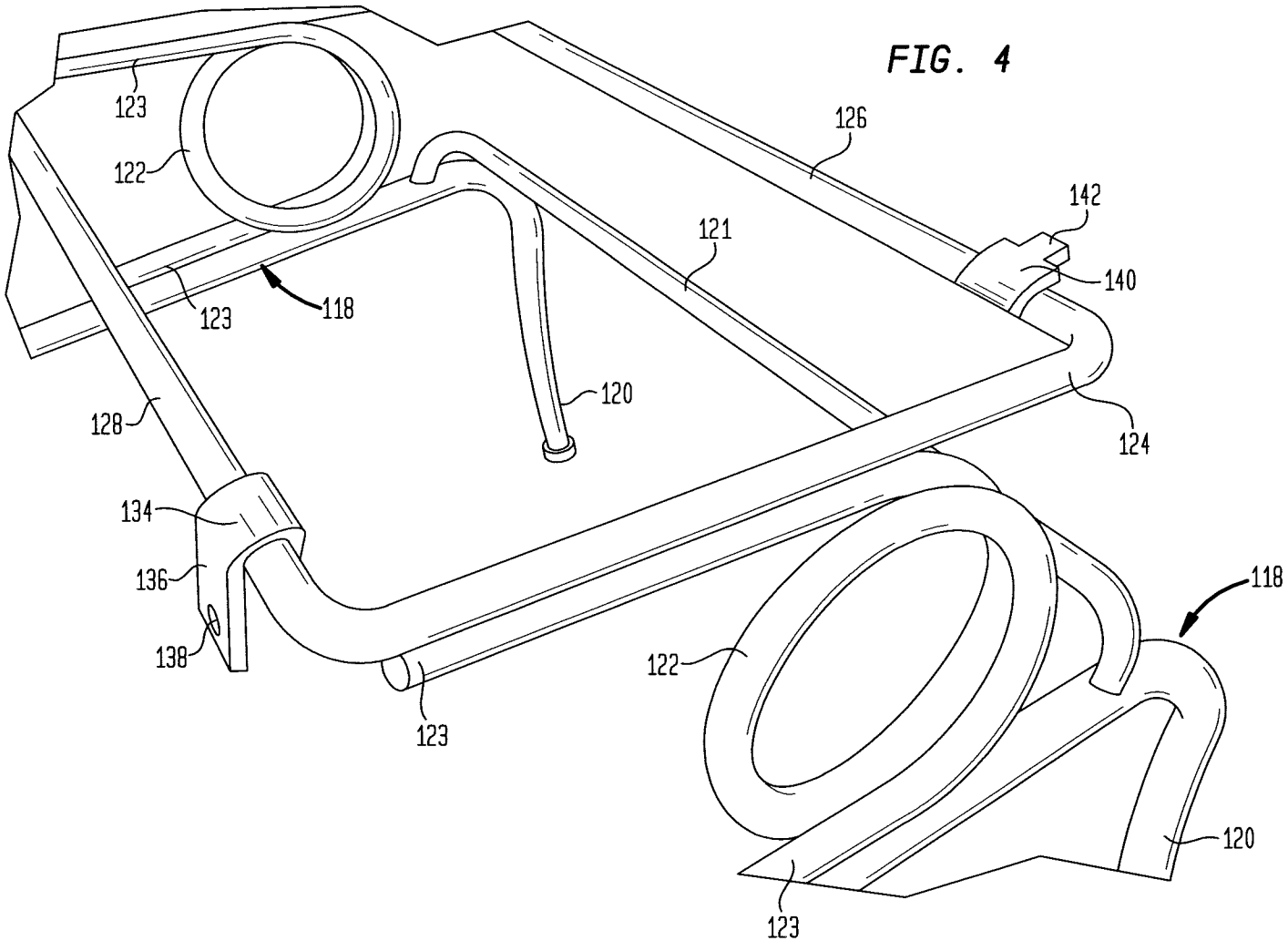
FIG. 4 is a perspective view of an enlarged section of the base assembly showing a portion of the connection assembly.

The base component 106, as further illustrated in FIGS. 2-4, is constructed from a pair of parallel spaced apart U-shaped leg frames 118 forming supporting legs 120 connected by cross braces 121. A vertically arranged coiled spring 122 is attached at an extension end 123 to each of the leg frames 118 by any suitable means such as welding, clamps, brazing, brackets and the like. Another extension end 123 of each coiled spring 122 is attached to an overlying connecting assembly supporting frame 124. The connecting assembly support frame 124 is illustrated, in the preferred embodiment, as a continuous rigid member of rectangular shape having spaced apart side members 126, 128. The base component 106, generally other than the coiled springs 122, can be constructed from hollow or solid metal members of any desirable cross sectional shape, such as round, oval, square and the like.

The resulting construction of the base component 106 provides the leg frames 118 spaced apart by cross braces 121 and connected to the connecting assembly support frame 124 by means of the pair of coiled springs 122. This provides the article of furniture 100 having the capability of rocking by virtue of the coiled springs 122. However, this is only one example of an article of furniture to which the present invention pertains. In this regard, it is not required that a rocking mechanism be employed in an article of furniture embodying the connecting assembly 108 as to be described hereinafter.

Figure 5:
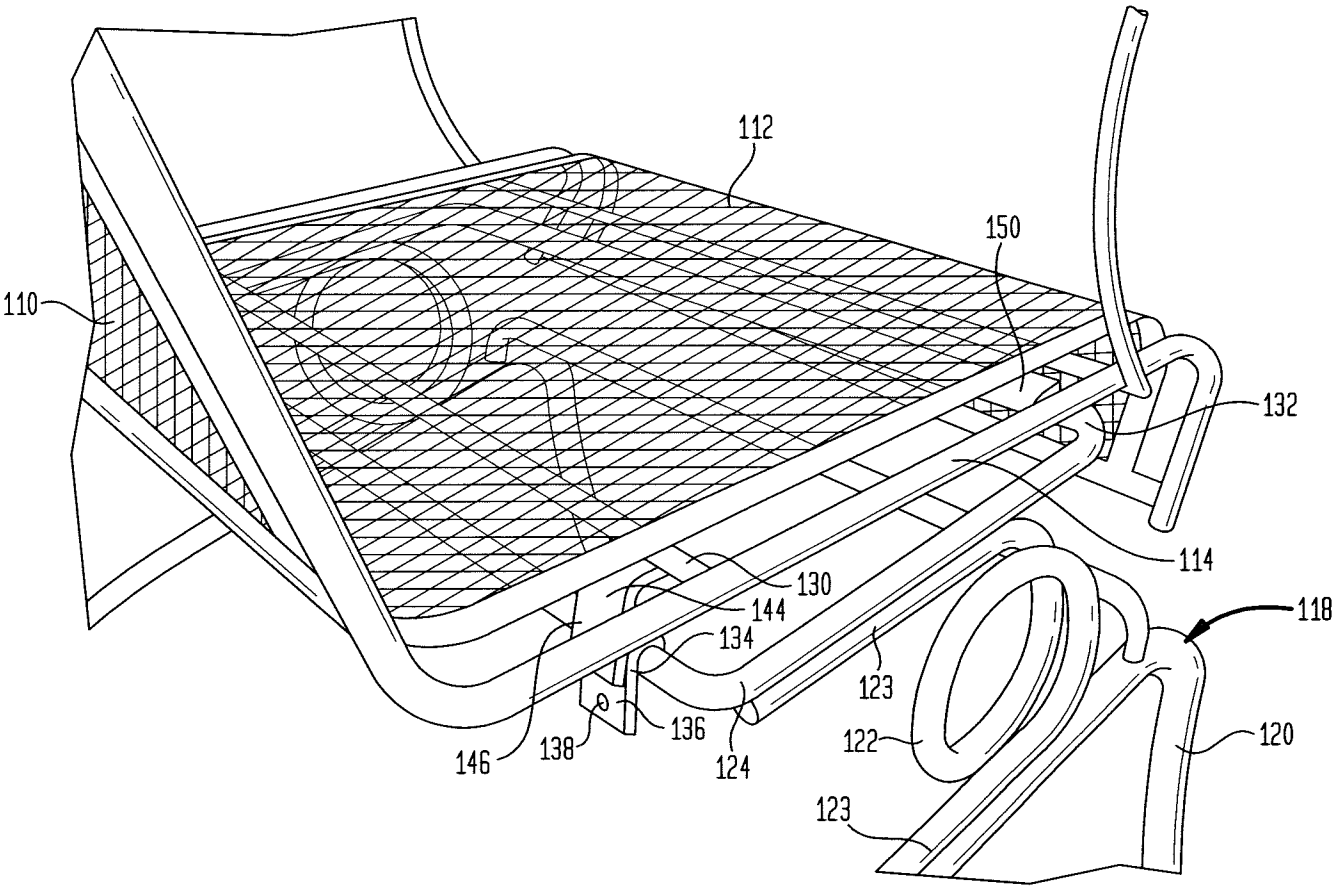
FIG. 5 is a perspective view showing the article of furniture having an occupant supporting component attached to the base component by the connection assembly.

Turning to FIGS. 1 and 5, there will now be described the construction of the connecting assembly support frame 114 which is attached to the occupant supporting portion 104. The connecting assembly support frame 114 is constructed from a continuous frame having a pair of spaced apart side members 130, 132. The connecting assembly support frame 114 may be of a similar construction to the connecting assembly support frame 124, such as a rigid tubular or hollow member attached to the occupant supporting component 104 underlying seat portion 112 by any suitable means. Although not required, in accordance with one embodiment of the present invention, the connecting assembly support frame 114 has a generally similar shape and size to that of the connecting assembly support frame 124.

The connecting assembly 108 will now be described with respect to FIGS. 2, 3, 5 and 6. The connecting assembly 108 is constructed from a plurality of brackets which are secured to the connecting assembly support frames 114, 124. As shown in FIGS. 2 and 3, the connecting assembly 108 includes a pair of angle brackets 134 attached to the side member 128 of the connecting assembly support frame 124 in spaced apart relationship. Each of the angle brackets 134 include a downwardly depending flange 136 provided with an opening 138. A pair of tab brackets 140 each having a horizontal projection 142 are attached to the side member 126 in spaced apart relationship. It is not a requirement of the present invention that the angle brackets 134 be aligned with the tab brackets 140.

Figure 6:
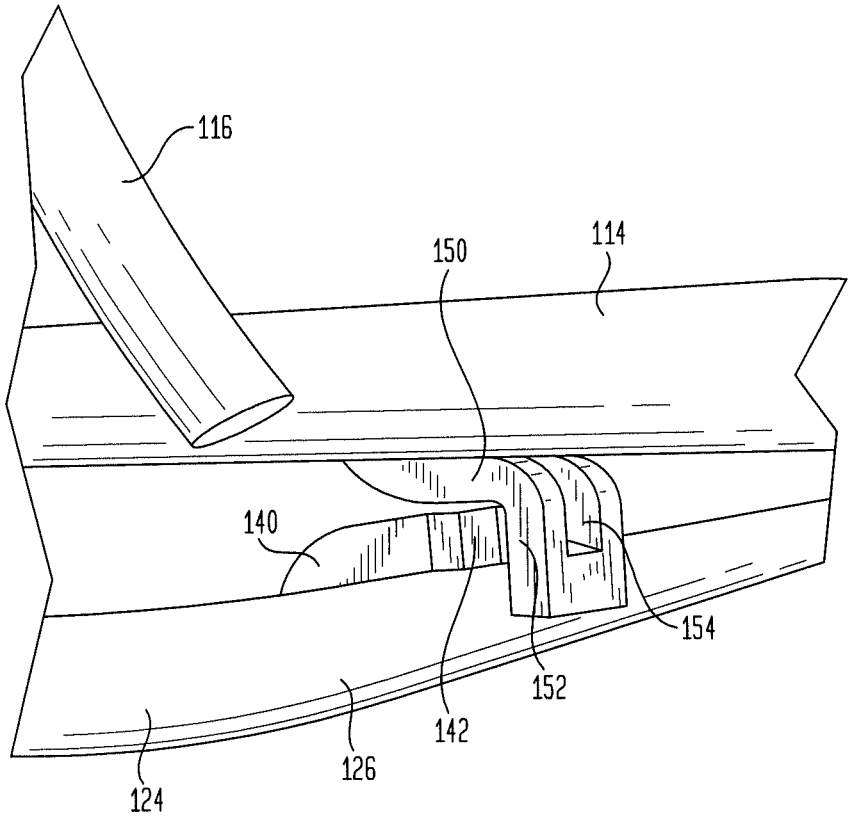
FIG. 6 is a perspective view of a portion of the connection assembly.
Figure 7:
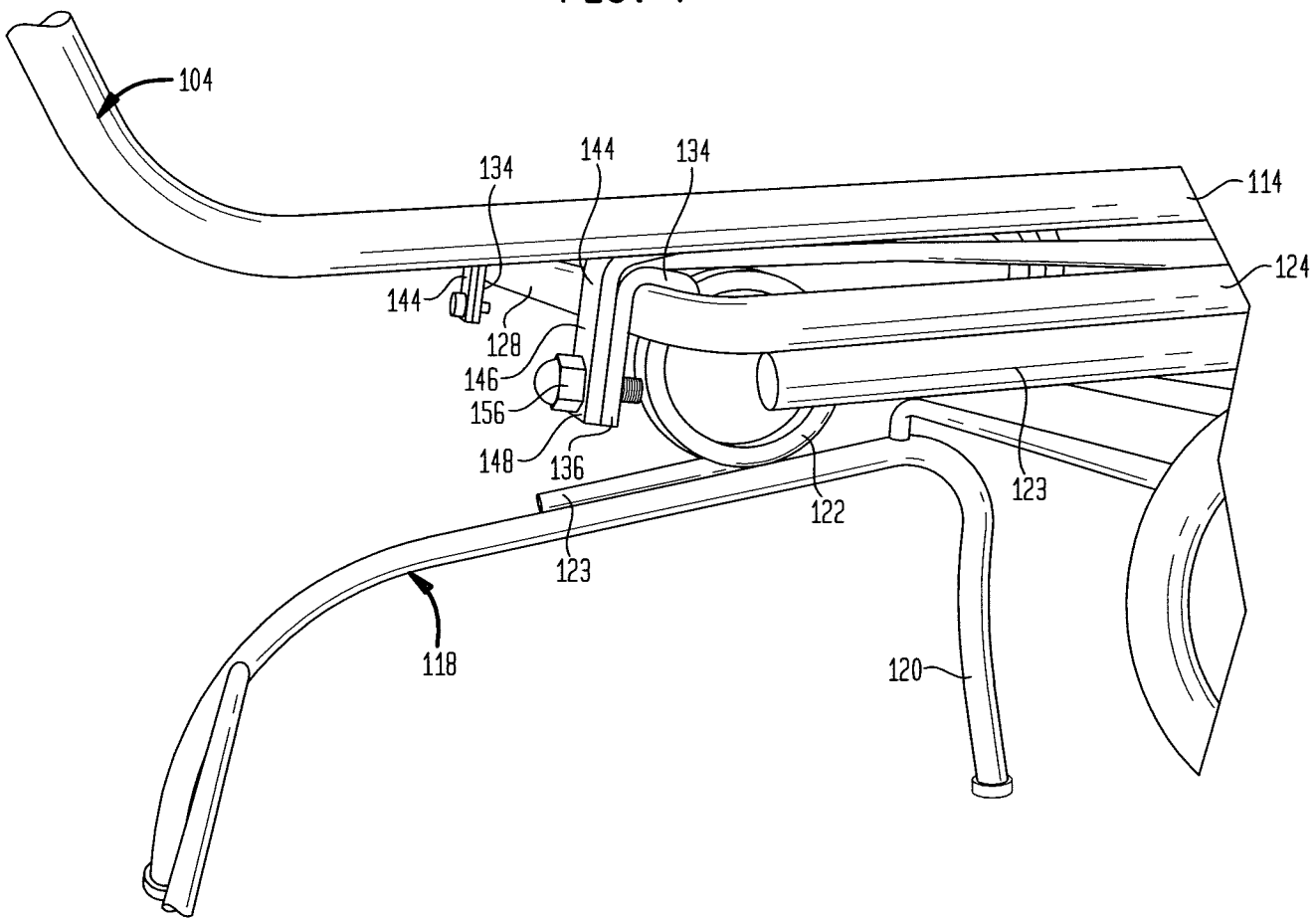
FIG. 7 is a perspective view showing another portion of the connection assembly.

The connecting assembly 108 further includes a pair of spaced apart angle brackets 144, see FIGS. 5 and 7, attached to the side member 130 of the connecting assembly support frame 114. Each of the angle brackets 144, of similar construction angle brackets 134, includes a downwardly depending flange 146 having an opening 148. A pair of angle brackets 150 is secured in spaced apart relationship to the side member 132. Each of the angle brackets 150, see FIG. 6, includes a shortened downwardly depending flange 152 having an enlarged opening 154. In a similar manner as previously described, is not a requirement that the angle brackets 144 be aligned with the angle brackets 150 within the connecting assembly support frame 114. However, it is required that the angle brackets 134 and tab brackets 140 attached to the connecting assembly support frame 124 align with the angle brackets 144, 150 attached to the connecting assembly support frame 114. This will become more apparent from a further description of the connecting assembly 108 in accordance with the present invention.

Although the angle brackets 144, 150 have been described as being attached to the connecting assembly support frame 114, the brackets may be attached to other portions of the occupant supporting component 104 thereby eliminating the support frame. For example, the angle brackets 144, 150 can be secured to bracing members underlying the seat portion 112. Likewise, the angle brackets 134 and tab brackets 140 can be secured to other portions of the base component 106 other than the connecting assembly support frame 124, depending upon its construction. It is therefore only required that the brackets 134, 140, 144, 150 be attached to the occupant supporting component 104 and base component 106 in a manner which allows for their alignment and connection during the assembly process.

Turning to FIGS. 5-7, there will now be described the securing of the occupant supporting component 104 to the base component 106 using the connecting assembly 108. The occupant supporting component 104 is generally positioned overlying the base component 106 with the brackets 134, 140, 144 and 150 in general alignment with each other. The occupant supporting component 104 is tipped forwardly such that the projections 142 of the tab brackets 140 align with and are receivable within the enlarged openings 154 of the opposing spaced apart angle brackets 150, see FIG. 6. Once the projection 142 is engaged with the enlarged opening 154, the occupant supporting component 104 is rocked rearwardly for mating the angle brackets 144 with a corresponding underline angle bracket 134 such that the corresponding openings 138, 148 are aligned with each other, see FIG. 7. The angle brackets 134, 144 are secured together by inserting a bolt 156 or other fastening means through their aligned openings. In this regard, it is contemplated that a nut may be used to secure the bolt 156, or that one of the openings 138, 148 may be threaded to secure the bolt and the corresponding brackets.

The use of the connecting assembly 108 in an article of furniture 100 enables the shipping of articles in a partially disassembled state, while permitting its assembly by the consumer in a simple manner which ensures the integrity and long use of the article without unintended disconnection. In this regard, the connecting assembly 108 attaches the base component 106 to the occupant supporting component 104 in a manner as effective and secure as if these components were fully assembled at the factory. The limited assembly only requires minimum effort by the consumer which can be accomplished in a matter of minutes. If necessary, the consumer can disassemble the base component 106 from the occupant supporting component 104 for any desired reason, such as storage or shipment to another location if desired.

The connecting assembly 108 has been described as comprising four brackets secured to the connecting assembly support frame 114 and four aligned brackets connected to the connecting assembly support frame 124. However, it is to be understood that any lesser or greater number of brackets may be employed in accordance with the present invention. For example, six brackets arrange in a triangular arrangement may be used, such as a pair of tab brackets 140 and a single angle bracket 134.

Figure 8:
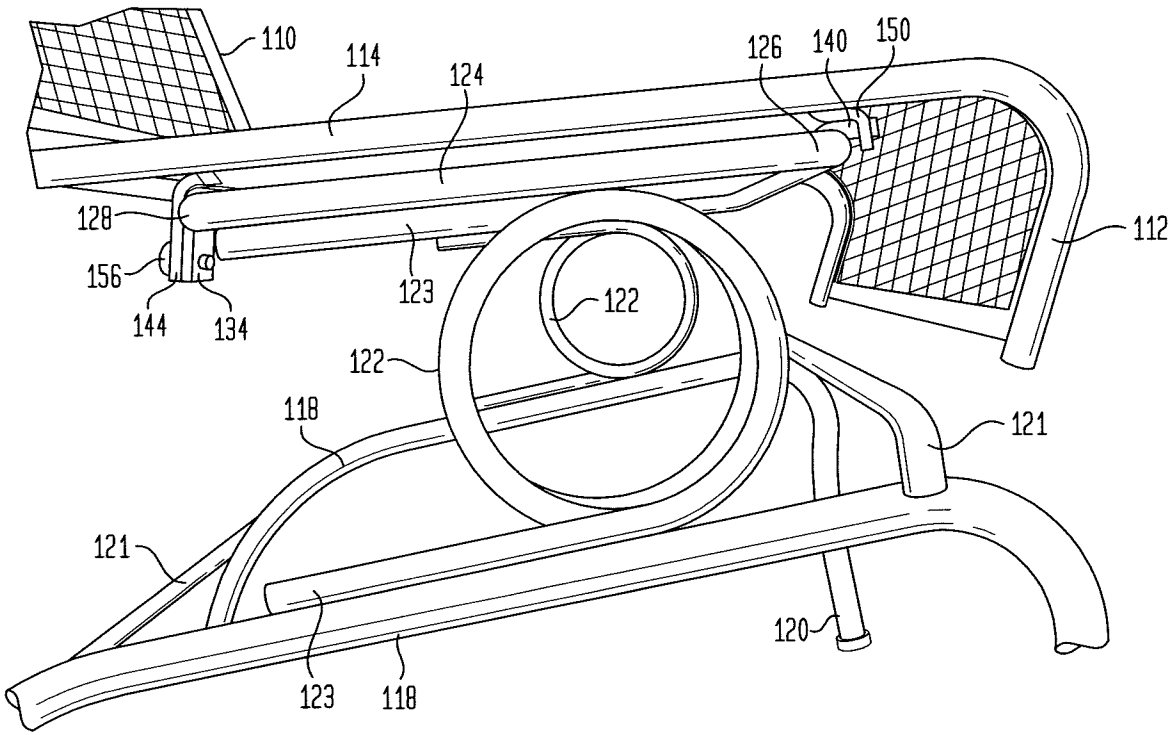
FIG. 8 is a perspective view of an article of furniture having a connection assembly in accordance with another embodiment of the present invention.

Referring now to FIG. 8, there is illustrated another embodiment of the present invention wherein the connecting assembly support frame 114 includes a pair of connecting brackets for mating with a pair of connecting brackets secured to the connecting assembly support frame 124. The connecting assembly support frame 124 includes a single angle bracket 134 attached to the side member 128 and a single tab bracket 140 connected to the side member 126. The connecting assembly support frame 114 includes a single angle bracket 144 secured to the side member 130 and a single angle bracket 150 secured to the side member 132. The assembly of the base component 106 to the occupant supporting component 104 using the connecting assembly 104 of four brackets is as previously described.

Figure 9:
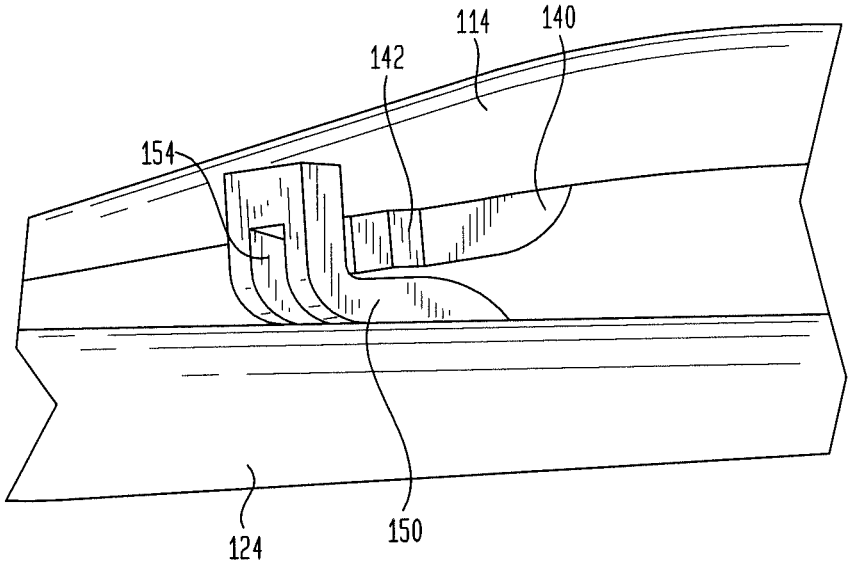
FIG. 9 is a perspective view of an article of furniture having a connection assembly in accordance with another embodiment of the present invention.
Figure 10:
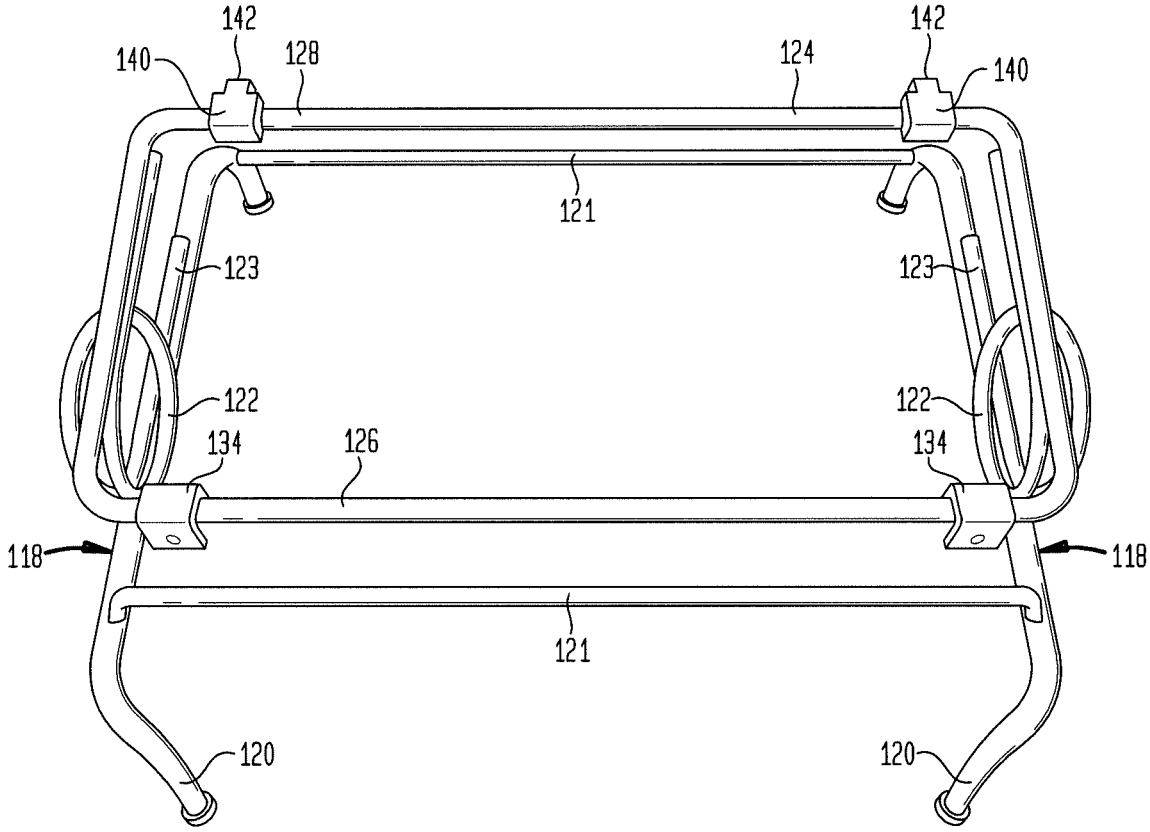
FIG. 10 is a perspective view of an article of furniture having a connection assembly in accordance with another embodiment of the present invention.
Figure 11:
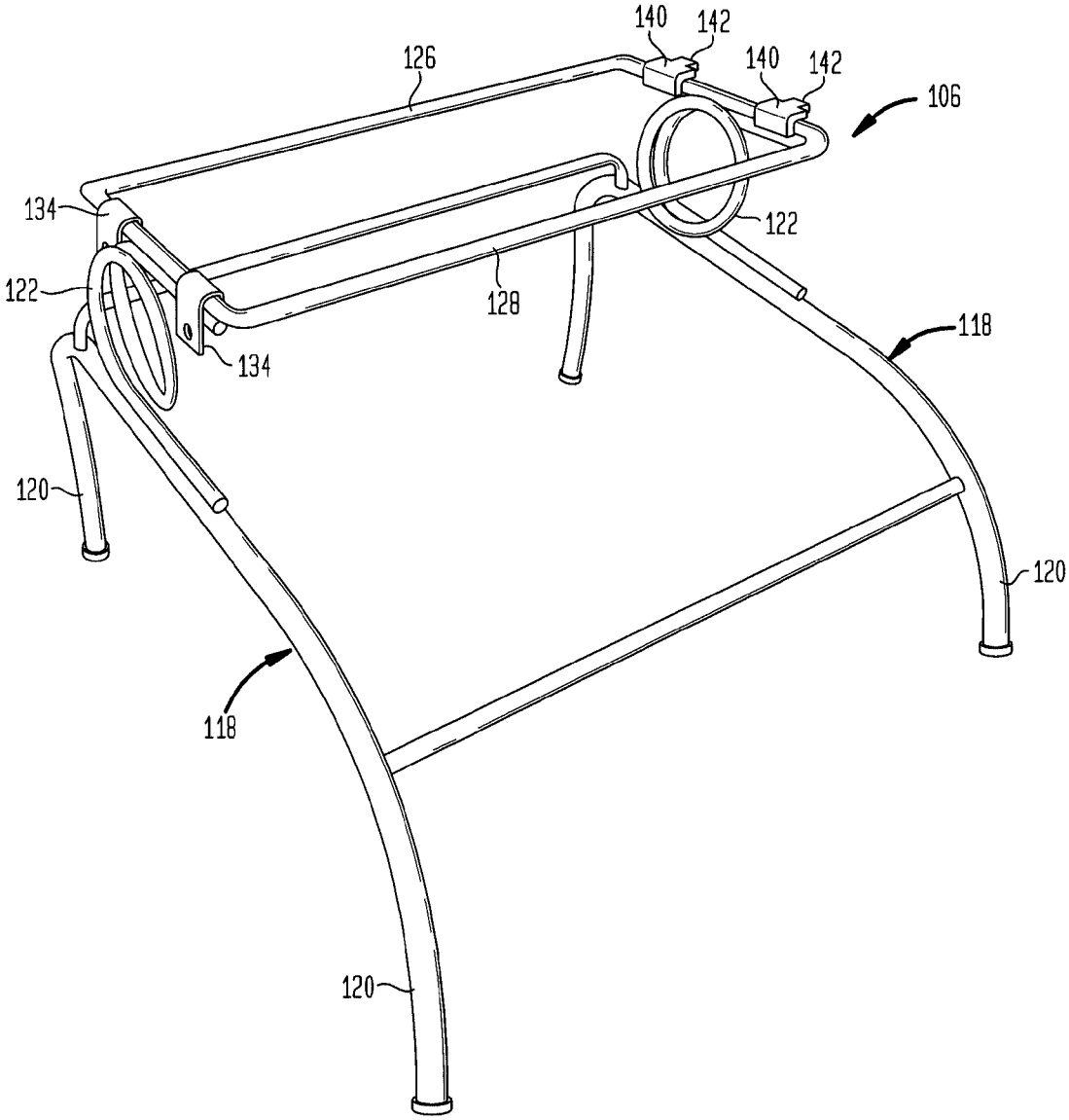
FIG. 11 is a perspective view of an article of furniture having a connection assembly in accordance with another embodiment of the present invention.
Figure 12:
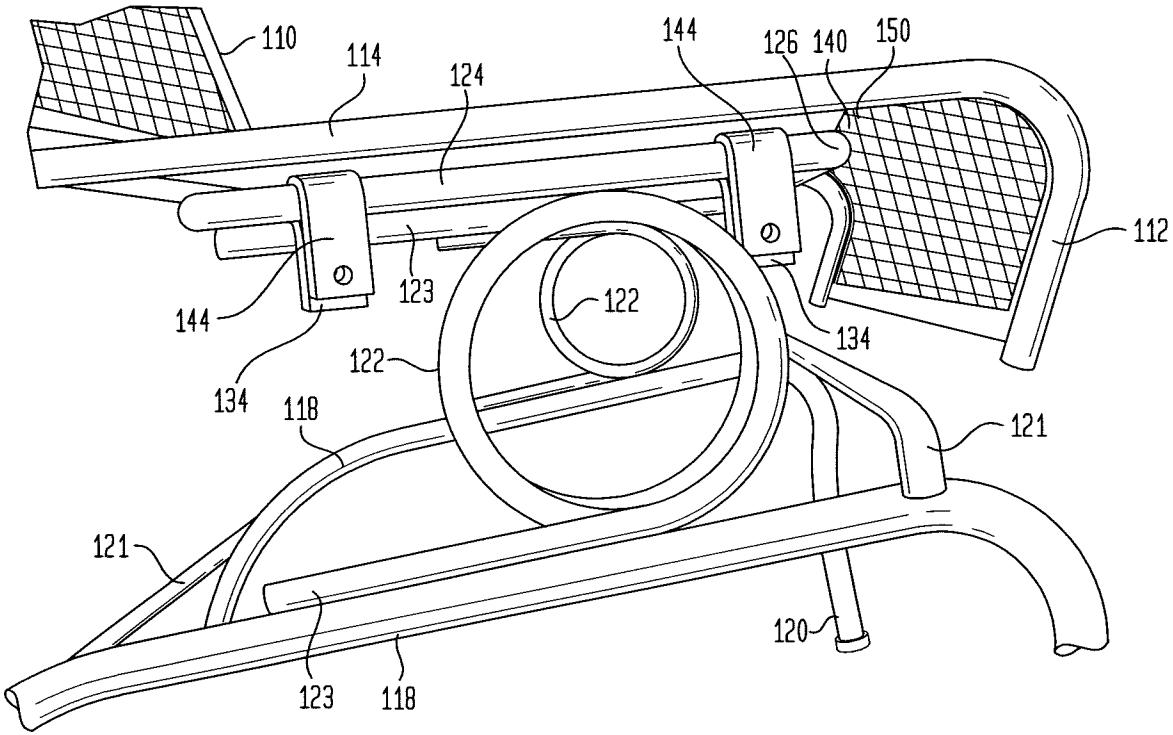
FIG. 12 is a perspective view of an article of furniture having a connection assembly in accordance with another embodiment of the present invention.

Although the invention herein has been described with reference to particular embodiments, it is to be understood that these embodiments are merely illustrative of the principles and applications of the present invention. For example, as shown in FIG. 9, it is contemplated that the tab brackets 140 can be attached to the connecting assembly support frame 114, with the mating angle brackets 150 attached to the connecting assembly support frame 124. In this regard, it is further contemplated that the angle brackets 150 would extend upwardly to engage the projection 142 on the angle brackets 140. The tab brackets 140 can also be attached to the side member 128 and angle brackets 134 to the side member 126, see FIG. 10. Moreover, as shown in FIGS. 11 and 12, it is contemplated that the brackets 134, 140, 150 can be attached to the side members connecting the side members 126, 128 together, or the side members connecting the side members 130, 132 together.

It is therefore to be understood that numerous modifications may be made to the illustrative embodiments and that other arrangements may be devised without departing from the spirit and scope of the present invention as defined by the appended claims.

The invention claimed is:

1. A ready to assemble article of furniture comprising:

a base component for supporting the assembled article on a surface;

a first support frame coupled to the base component;

a pair of spaced apart springs arranged between the base component and the first support frame securing the first support frame in spaced apart relationship to the base component;

first and second brackets directly attached to the first support frame in spaced relationship;

an occupant supporting component for supporting an occupant when secured to the base component;

a second support frame underlying the occupant supporting component and coupled thereto; and third and fourth brackets directly attached to the second support frame in spaced apart relationship, the first bracket connectable with the third bracket and the second bracket connectable with the fourth bracket when the supporting component is assembled to the base component.

2. The article of claim 1, wherein the first bracket includes a projection and the third bracket includes an opening for receiving the projection when the supporting component is assembled to the base component.

3. The article of claim 2, wherein the second bracket includes an opening and the fourth bracket includes an opening aligned with the second bracket opening when the supporting component is assembled to the base component.

4. The article of claim 3, further includes a fastener inserted into the aligned second and fourth bracket openings for securing the second and fourth brackets together.

5. The article of claim 4, wherein the springs each comprise coil springs.

6. The article of claim 1, further including at least two additional brackets attached to the first support frame in spaced apart relationship, and at least two additional brackets attached to the second support frame in spaced apart relationship.

7. The article of claim 6, wherein one of the additional brackets attached to the first support frame includes a projection and the remaining additional brackets each include an opening.

8. The article of claim 1, wherein the article comprises a rocking chair or rocking couch.

9. The article of claim 1, wherein the first and second support frames each comprise a rigid continuous member.

10. The article of claim 1, wherein the first bracket includes a projection arranged transverse to the second bracket.

11. The article of claim 1, wherein the pair of spaced apart springs are attached directly to the base component and the first support frame.

12. An article of furniture comprising:

a base component for supporting the article of furniture on a surface;

a first support attached to the base component;

a pair of spaced apart coiled springs attached to the first support frame and the base component in spaced apart relationship;

first, second, third and fourth brackets attached to the first support frame in opposing pairs; the first and second brackets each including a projection and the third and fourth brackets each including an opening;

an occupant supporting component for supporting an occupant;

a second support frame attached to the occupant supporting component;

fifth, sixth, seventh and eighth brackets attached to the second support frame in opposing pairs, the fifth, sixth, seventh and eighth brackets each including an opening;

the occupant supporting component secured to the base component by (i) the projections of the first and second brackets received within a corresponding opening of the fifth and sixth brackets, (ii) the openings of the third and seventh brackets being aligned and the openings of the fourth and eighth brackets being aligned, and (iii) a fastener received with the aligned openings of the third and seventh brackets and the fourth and eighth brackets.

13. The article of claim 12, wherein the fastener comprises a bolt.

14. The article of claim 12, wherein the article comprises a rocking chair or rocking couch.

15. The article of claim 12, wherein the first and second support frames each comprise a rigid continuous member having the same shape.

16. The article of claim 15, wherein the first and third brackets are arranged transverse to each other, and the second and fourth brackets are arranged transverse to each other.

17. The article of claim 16, wherein the third, fourth, fifth, sixth, seventh and eighth brackets each comprise angle brackets.

18. A ready to assemble article of furniture comprising:

a base component for supporting the assembled article on a surface;

an occupant supporting component for supporting an occupant when secured to the base component;

at least four first brackets coupled to the base component or to the occupant supporting component in spaced apart relationship;

at least four second brackets coupled to the occupant supporting component or the base component in spaced apart relationship; and wherein at least one of said first brackets includes a projection for engagement with an opening in one of said second brackets, and at least another one of said first brackets includes an opening for alignment with an opening in another one of said second brackets for securing the base component to the occupant supporting component.

19. The article of claim 18, further including a pair of coiled springs coupled between the base component and the occupant supporting component.

20. The article of claim 19, wherein the four first brackets are attached to the base component and the four second brackets are attached to the occupant supporting component.

21. The article of claim 20, wherein the first support frame is attached to the base component in spaced apart relationship by the coiled springs.

22. The article of claim 21, wherein said second support frame is attached to said occupant supporting component.

23. The article of claim 21, wherein one of said first brackets including said projection is coupled to said base component.

24. The article of claim 19, wherein two of said first brackets include a projection for respective engagement with an opening in two of said second brackets.

25. A ready to assemble article of furniture comprising:

a base component for supporting the assembled article on a surface;

a first support frame coupled to the base component;

a pair of spaced apart springs arranged between the base component and the first support frame securing the first support frame in spaced apart relationship to the base component;

first and second brackets attached to the first support frame in spaced relationship;

an occupant supporting component for supporting an occupant when secured to the base component;

a second support frame underlying the occupant supporting component and coupled thereto;

third and fourth brackets attached to the second support frame in spaced apart relationship, the first bracket connectable with the third bracket and the second bracket connectable with the fourth bracket when the supporting component is assembled to the base component;

at least two additional brackets attached to the first support frame in spaced apart relationship; and at least two additional brackets attached to the second support frame in spaced apart relationship.

* * * * *